US006494641B1

(12) United States Patent
Bracale et al.

(10) Patent No.: US 6,494,641 B1
(45) Date of Patent: Dec. 17, 2002

(54) TACK-IT EZ; ASPHALT TOOL TO DISPENSE TACK EMULSION ON EXISTING CONCRETE OR ASPHALT CURB FACE OR EDGES

(76) Inventors: Ronald Steven Bracale, 1150 E. Deuce of Clubs #B, Show Low, AZ (US) 85901-4902; Cynthia Slaughter Bracale, 1150 E. Deuce of Clubs #B, Show Low, AZ (US) 85901-4902

( * ) Notice: Subject to any disclaimer, the term of this patent is extended or adjusted under 35 U.S.C. 154(b) by 3 days.

(21) Appl. No.: 09/733,547

(22) Filed: Dec. 7, 2000

Related U.S. Application Data

(60) Provisional application No. 60/171,753, filed on Dec. 22, 1999.

(51) Int. Cl.[7] ..... E01C 19/16
(52) U.S. Cl. ..... 404/111; 404/101; 404/108
(58) Field of Search ..... 404/83, 85, 86, 404/93, 94, 95, 98, 101, 108, 111

(56) References Cited

U.S. PATENT DOCUMENTS 3,897,078 A * 7/1975 Melnick et al. ..... 280/15
3,913,942 A * 10/1975 MacKenzie et al. ..... 280/150.5
5,050,904 A * 9/1991 Lagsdin ..... 280/764.1
5,054,812 A * 10/1991 Lagsdin ..... 280/764.1
5,427,424 A * 6/1995 Robinson ..... 294/50.9
5,671,553 A * 9/1997 Burkhart ..... 37/270
5,906,145 A * 5/1999 Shepherd ..... 81/45
6,115,899 A * 9/2000 Rider ..... 29/243.5
6,128,979 A * 10/2000 Shepherd ..... 81/45
6,164,710 A * 12/2000 Shibuya ..... 294/1.5
6,318,213 B1 * 11/2001 Hendrix et al. ..... 81/45

* cited by examiner

*Primary Examiner*—Thomas B. Will
*Assistant Examiner*—Alexandra K. Pechhold

(57) ABSTRACT

A shovel and shovel handle attached to a cylinder for dispensing liquid binding tack emulsion on curb faces or edges prior to paving asphalt on roads. Emulsion solution is poured in the cylinder top and dispensed from a hole at the bottom of a cylinder cap. An idler wheel is attached onto a rod connected to a deflector shield in one embodiment, or by U-bolt assembly onto the front of the cylinder in another embodiment. A hook rod is inserted in the cylinder and is pulled upward to allow the solution to flow out of the cylinder. The deflector shield keeps the solution against the shovel head, while solution is being distributed evenly along the curb face or edge.

6 Claims, 6 Drawing Sheets

TACK-IT EZ; ASPHALT TOOL TO DISPENSE TACK EMULSION ON EXISTING CONCRETE OR ASPHALT CURB FACE OR EDGES

CROSS-REFERENCE TO RELATED APPLICATIONS

This application is entitled to the benefit of Provisional Patent Application Ser. No. 60/171,753, filed Dec. 22, 1999.

BACKGROUND

1. Field of Invention

This invention benefits the paving industry when the tack emulsion is to be applied prior to paving on existing concrete curb face or asphalt edge to adhere to the newly laid asphalt.

2. Description of Prior Art

No prior art found.

GENERAL DESCRIPTION ALTERNATE WAYS

To dispense or apply tack emulsion solution to an existing concrete curb face or asphalt edge, for the purpose of adhering to the newly paved asphalt. Tack, as it is commonly known in the asphalt construction industry business, is an asphaltic emulsion solution, liquid asphalt, or a variety of other substances which are applied onto a surface that is to be paved only to existing asphalt. A tack truck, commonly known as a boot truck, would apply a tack overlay to the old existing asphalt road just prior to the new asphalt paving placement. This area is however only on the main road surface and not for the curb face and edges, because precision and accuracy is not always achieved. Most boot trucks are able to spray or apply to the curbs with a spray wand unit on the boot truck, or boot trailer. The spray wand can be used to apply tack, but it is costly when complaints are called in because of getting the black tack solution, aggravated by wind conditions and other unpredictable factors, on other areas besides where the tack is to be applied.

When the road grade work is complete, that is when the road surface doesn't need tack, but the curb edges will have to be tacked. There are a lot of jobs with new construction, which means no previous asphalt is existing. When only the concrete curb face needs tack, the expense of a boot truck would not be logical. That is when you need something smaller to efficiently tack the curbs or edges that the new asphalt will have to bind to.

Many asphalt road companies have what is called a boot trailer, or boot wagon which holds the tack emulsion that is sprayed on the curbs or edges. The boot trailer is hooked on a pick-up truck and two men are involved, one to drive the pick-up truck to pull the boot trailer, while another man is spraying tack. Occasionally a tack clot goes thru the spray nozzle and it could mean tack spitting different directions. The inspectors on the job site will not allow tack above the pavement line or on the sidewalk. Any tack solution showing on areas other than where it is supposed to be will be removed at the expense of the company spraying tack.

Vertical curbs are hard to judge spraying with a boot trailer or boot truck. The spraying process can result in over spray which can create a messy situation especially when the wind is blowing. If the boot trailer or boot truck is not already owned by the company doing road construction then this equipment is costly to purchase and expensive to rent.

In the paving construction field when the curb is the only tack item to be tacked, some companies have used paint brushes to apply the tack, while others use the cup dipping method. Dipping a cup into the tack solution and putting the cup next to the curb while trying to pour the tack emulsion solution onto the curb face. This is hard to do without making a mess. Some have used the shovel method, pouring the tack onto a shovel that is held against the curb and walking using the shovel edge as a guide. This would involve two men, one holding the shovel while the other man is constantly dipping a cup in the bucket of tack solution and pouring it onto the shovel. These methods are simple and both work, but they are back breaking and time consuming .

SUMMARY

TACK-IT EZ is a useful asphalt hand tool device to apply tack solution on the road edge of concrete curbs and asphalt edges. It's very easy to manage and operate. Pour tack solution in cylinder, place idler wheel on existing curb, pull hook rod up and walk on the side of curb. Tack is dispensed evenly on the side of curbs. All models work the same, except the Model VC500 has a feature that allows the idler wheel to be adjustable to the desired height.

Objects and Advantages

Accordingly, besides the objects and advantages of the TACK-IT EZ described in my above patent, several objects and advantages of the present invention are:

(a) to provide an asphalt hand held device that will dispense tack solution on existing concrete curb face and asphalt edge face;

(b) to provide an asphalt hand tool that will make pothole tacking easy to handle;

(c) to provide an asphalt hand tool that will be easy to handle and operate, all asphalt crew members can handle a shovel;

(d) to provide an asphalt hand tool that eliminates the normally back breaking task of applying tack to curb face and edges;

(e) to provide an asphalt hand tool that eliminates the messy and sloppy appearance of other methods that are used to apply tack to curb face and edges;

(f) to provide an asphalt hand tool that will eliminate getting tack all over hands for a job that can be messy otherwise;

(g) to provide an asphalt hand tool that can be cleaned and maintained fairly easy;

(h) to provide an asphalt hand tool that can stand by itself while pouring the tack solution into the cylinder, allowing one man to fill cylinder;

(i) to provide an asphalt hand device that can accommodate the curb tacking job;

(j) to provide an asphalt hand tool that can apply tack solution to the hard to do vertical curbs and edges and get a more professional job appearance;

(k) to provide an asphalt hand tool that can apply tack with the one man operation procedure, it virtually eliminates the two man operation procedure;

(l) to provide an asphalt hand tool that can eliminate using tack trailers or a tack truck, creating a time and expense saver;

(m) to provide an asphalt hand tool that is approximately fifty-six inches (56") tall and approximately twelve inches (12") in depth, for the largest model, which makes it extremely portable and space efficient;

(n) to provide an asphalt hand tool that can be easily carried in just a relatively small space in the back of the pick-up work truck and be readily available;

(o) to provide an asphalt hand tool that can be produced in the different but similar models;

(p) to provide an asphalt hand tool that can be manufactured fairly inexpensively;

Further objects and advantages are to provide an asphalt tool which can be used easily and conveniently in applying tack solution to the existing concrete curb face and asphalt edges, without defacing the curb and edges with excessive tack solution. This asphalt tool which is simple to use and inexpensive to manufacture, can be supplied in different but similar models, which can be used repeatedly. Still further objects and advantages will become apparent from a consideration of the ensuing description and drawings.

DRAWING FIGURES

FIG. 1 is the front side view of Model MP300 that will tack curb face or edge.

FIG. 2 is a pull apart that shows Model MP300 that will tack curb face or edge.

FIG. 3 is the front side view of Model MP400 that will tack curb face or edge.

FIG. 4 is the pull apart that shows Model MP400 that will tack curb face or edge.

FIG. 5 is a front side view of the Model VC500 that will tack vertical curb face or edge.

FIG. 6 is a pull apart that shows Model VC500 that will tack the vertical curb face or edge.

DESCRIPTION OF INVENTION

A square point shovel with a sheet metal crimped deflector shield 52 and idler wheel 62 assembly unit attached to the bottom of the shovel head 22, or u-bolt assembly unit 68 attached to the front of cylinder 30. A three inch (3") or four inch (4") diameter cylinder 30 or 40 is attached to the front of a shovel handle 20 and front of shovel head 22. The TACK-IT EZ is an applicator to dispense asphalt emulsion on curbs, edges, vertical curbs and numerous other places where the new asphalt is to be laid.

PREPARING THE SHOVEL HEAD

The first items to be done to start assembly of the TACK-IT EZ are to drill the holes B and C in the shovel head 22. A one-half inch (½") hole C is drilled, centered in shovel head 22 one and one-half inches (1½") from bottom to center of hole. This hole C is where the idler wheel 62 and deflector 52 are inserted later on Models MP300 and MP400. On the Model VC500 as seen in FIGS. 5 and 6, the deflector 52 does not have the idler wheel 62 attached to it. The idler wheel 62 is on the ½"×14" smooth rod 64. The deflector 52 hole D will align with hole C in the shovel head 22, with the proper nuts and bolts to attach to the shovel head 22.

A three-eighth inch (⅜") hole B is drilled from the bottom edge measuring to top of shovel head 22 approximately seven and one-half inches (7½") from center of hole to bottom of shovel head 22. This hole B is centered in the middle of back side in the forged valley of the shovel head 22. The bottom side hole F of the cylinder 30/40 will align in this hole B.

FORMING THE KICK STAND

The next item to bend and place on shovel head 22 is the ¼"×36" smooth rod kick stand 24. As seen in FIGS. 1 thru 6. This specially designed kick stand 24 is bent to frame the shovel head 22 and tucks under the rolled edges behind the shovel head 22. The rod for the kick stand 24 is bent eight and one-half inches (8½") wide on the bottom side. Nine and one-half inches (9½") vertical height on sides, then it is bent horizontally toward middle for a length of two and one-half inches (2½"), from the horizontal length it is bent upward on both sides up approximately two inches (2") at the top. This part is open and the total kick stand 24 conforms with the shovel head 22.

At the top where the width is two and one-half inches (2½"), before the open upward ends, both horizontal ends are inserted on the back side under the rolled edges of the shovel head 22. The rolled edges on the back side of shovel head 22 are then pounded down with pressure enabling the kick stand 24 to stay under the rolled edges. On top of the kick stand 24 at both open ends the ¼" thread protectors 26 are placed on.

The bottom of the kick stand 24 is aligned and held in place by snapping the kick stand 24 against the outer bottom edge of the ½" self locking coarse thread hex nut 56 against the back side of shovel head 22, which holds the deflector idler wheel assembly 52/62 or just the deflector 52 in the Model VC500. This enables the kick stand 24 to stay in closed position against the shovel head 22 and out of the way when the TACK-IT EZ is in use. The operator when using the TACK-IT EZ kicks the thread protector 26 to open the kick stand 24 enabling the TACK-IT EZ to stand by itself, leaving both hands free to fill cylinder 30/40 with the asphalt emulsion solution called tack coat. When the operator is ready to use the TACK-IT-EZ, after filling cylinder 30/40, the operator using foot, pushes the bottom of the kick stand 24 against back of shovel head 22 and snaps it under the lock nut 56, this is done on all the models.

ASSEMBLY OF DEFLECTOR IDLER WHEEL-Models MP300 and MP400

In the next stage of assembly, the three inches (3") in diameter idler wheel 62 with the deflector shield 52 will be explained in detail of all components, as shown in the drawings on FIGS. 1, 2, 3, 4 in the two models displayed. (Note: the idler wheel is a clothes dryer drum roller; the reason for use of this idler wheel was because it is very durable, withstands heat, is structurally sound, can withstand constant rolling motion, and lasts for years.) The deflector idler wheel 52/62 is pre-assembled and semi-tightened.

On the 2⅞"×8" steel metal deflector shield 52 a one-half inch (½") hole D is pressed out one and one-quarter inches (1¼") from the top to the center of the hole D and should be one and five-eighth inches (1⅝") from the bottom on the deflector 52 edge to the center of the hole D. Each of the four corners of the deflector 52 are snipped off a sixteenth (1/16") of an inch for safety reasons. The deflector 52 is then crimped at approximately a thirty-five (35) degree angle, three-quarter inch (¾") from the top of deflector 52 with the angle flaring up, away from shovel head 22. One inch (1") from bottom edge of deflector 52 it is crimped at approximately a thirty-five (35) degree angle. The angle flares down, away from the idler wheel 62, going toward the shovel head 22.

The ½"×6" threaded rod 54 is bent at approximately a seventy (70) degree angle, with three and one-half inches (3½") on one side of the bend, and two and one-half inches (2½") on the other side of the bend.

Working only on the rod 54 with the three and one-half inch end (3½"), two ½" nuts 58 are screwed on, then the idler wheel 62 is put on with the final ½" self locking coarse thread hex nut 56 screwed on and tightened. The lock nut 56 is the last at the end of the rod 54, screwed on and tightened flush with the end of rod 54.

At the two and one-half inch (2½") end of rod 54 a ½" nut 58 is screwed on. Then the rod 54 is inserted thru the hole D on the deflector 52 with the smaller angle flare at the top going up and out away from shovel head 22. The larger flare angle on the deflector 52 is right behind the idler wheel 62, it flares in toward shovel head 22. In back of the deflector 52, on the rod 54, before putting thru hole C in shovel head 22, another nut 58 is screwed on next to the deflector 52, with a ½" lock washer 60 that will be next to shovel head 22, under the deflector 52. At this point the rod 54 with the idler wheel 62 and deflector 52 is inserted thru the bottom one-half inch (½") hole C of the shovel head 22, with a final lock nut 56 screwed on the back side of shovel head 22. The idler wheel 62 is angled toward the bottom edge of shovel head 22. This is all bolted, tightened and aligned with the lock nut 56 flush to the end of the rod 54. This is known as the deflector idler wheel assembly 52/62. The deflector idler wheel 52/62 can be seen assembled in FIGS. 1 and 3. Specifically designed for Models MP300 and MP400.

The Model VC500 has a different idler wheel assembly 62 seen in FIG. 5. Known as the unbolt assembly 68 with an adjustable idler wheel 62 as part of the assembly. A deflector 52, without the idler wheel 62 hooked to it, which will be told in detail later.

DEFLECTOR ON MODEL VC500

With the hole C that was drilled in center of shovel head 22 and one and one-half inch (1½") from bottom which will align with the hole D pressed in crimped deflector 52. The ½"×1¼" coarse threaded bolt 38 will be inserted thru the front of deflector 52 thru hole D. On the back side of the deflector 52, a nut 58 is put on as a spacer, with a lock washer 60 that will be next to the shovel head 22. With the bolt 38 and nut 58 with lock washer 60, this is inserted thru the shovel head 22 going thru bottom hole C. The smaller crimped deflector 52 edge at the top flaring out away from shovel head 22 and on the bottom part of deflector 52 angled down toward shovel head 22. A locking nut 56 is screwed on to the back side of shovel head 22 on the bolt 38 and tightened. This will finish the assembly with the deflector 52 on Model VC500.

DETAILED ASSEMBLY OF CYLINDER

The installation of the 3" or 4" cylinder tube 30 or 40 is done in various stages. FIGS. 2 and 6 detail the 3" in diameter cylinder 30 with a 3" cylinder cap 32 while FIG. 4 details the 4" cylinder 40 with the 4" cylinder cap 42. This installation is done the same way on all models.

The first stage is preparing the cylinder 30/40, which is put on after the deflector idler wheel assembly 52/62. The cylinder 30/40 is cut nineteen and one-half inches (19½") long. A three-eighth inch (⅜") hole F is drilled three and one-half inches (3½") from the bottom of the edge of the cylinder 30/40, this hole F will line up to the upper three-eighth inch (⅜") hole B which was drilled in the shovel head 22. Make note both 7/16" square nuts on 44 and 48 are reamed out to thirteen thirty-seconds inches (13/32") before placement in the cylinder 30/40. The 7/16" square nut welded to ⅜"×2" all thread bolt 48, is inserted in the cylinder 30/40 bottom hole F with the 7/16" square nut 48 on the inside of the cylinder 30/40 and aligned that the hook rod 28 will go thru the hole in the 7/16" square nut 48. A ⅜" nut 50 will screw on the threaded open end of ⅜"×2" bolt 48 on the outside of the cylinder 30/40. This is the first of three nuts 50, then the second of three nuts 50, making this a spacer, which is between the front side of the shovel head 22 and behind the first nut 50.

Special attention is needed before the cylinder 30/40 is fastened to shovel head 22 thru hole B. The 7/16" square nut on ⅜"×2" bolt 48 is secured inside cylinder 30/40, with two of the three nuts 50 on the outside of cylinder 30/40. One of the two nuts 50 on the outside against cylinder 30/40 to secure the bolt and the second nut 50 will be tightened against front side of shovel head 22. Then the 3" or 4" cylinder cap 32/42 is cemented with ABS cement, and secured on bottom of cylinder 30/40. The third and final ⅜" nut 50, is placed on the back of the ⅜"×2" bolt 48 after it is inserted thru hole B on shovel head 22, this will screw on and be tightened to set flush to the backside of the shovel head 22. The cylinder 30/40 is put on the shovel head 22 with just the bottom hole F of cylinder 30/40 holding it to the hole B in shovel head 22 for now.

Sited and aligned the final three-eighth (⅜") hole A, on the shovel handle 20, will be drilled approximately two and one-quarter inches (2¼") up from the metal on the shovel head 22, this can vary from the measurement. Drilling hole A thru the shovel handle 20 and holding the upper part of cylinder 30/40 for the placement to be exact for the top hole E in cylinder 30/40 and simultaneously drilling hole A in the shovel handle 20, going thru to also drill hole E in cylinder 30/40.

The ⅜" hex nut welded to 7/16" square nut 44 is held inside the cylinder 30/40, with the ⅜"×2" bolt 46 that is inserted first thru the back of shovel handle 20 hole A, going thru square nut 44. This is temporarily screwed and tightened on the square nut 44 inside the cylinder 30/40 for the placement of drilling hole G on bottom of the cylinder cap 32/42. A ⅜" extended drill bit is put down thru the inside of the cylinder 30/40 and thru both 7/16" square nuts 44 and 48 to drill hole G in the bottom of cylinder cap 32/42. This is the open and closure hole G for the hook rod 28 to pull up and down, to open and close hole G. The hole G is for the solution to dispense between shovel head 22 and deflector 52 for application of tack solution. After hole G is drilled in cylinder cap 32/42 the square nut 44 at the top of cylinder 30/40 is removed until hook rod 28 is prepared.

ASSEMBLY OF U-BOLT IDLER WHEEL-Model VC500

Also in FIGS. 5 and 6 are the ⅜"×3½" u-bolt assembly 68, which consists of two like units that will wrap around the cylinder 30. Both u-bolt assemblies 68 are fastened on back side of cylinder 30, with the straps and nuts that comes complete with kit. The ½"×14" smooth rod 64 is bent in middle to form angle at sixty (60) degrees. Then either side, starting with rod 64 will be welded to the front mid points of both units in the u-bolt assembly 68, prior to attachment on the cylinder 30. Weld together starting with top of rod 64 flush with top of mid point of one u-bolt assembly 68. Then measure approximately five inches (5") on rod 64 below first u-bolt assembly 68 to place the second u-bolt and weld assembly 68 as seen in FIGS. 5 and 6. The two alike unit u-bolts 68 will now be attached together by the rod 64. The ½"×2" bolt welded to ½" lock collar 66 will slip on the smooth rod 64, with one ½" nut 58, used as a spacer, going on the bolt 66. The 3" in diameter idler wheel 62 is put on next to the nut 58. Then a locking nut 56 will be flush against the end of bolt 66, tightening on the ½"×2" bolt welded to ½" lock collar 66. The idler wheel 62, will be totally adjustable to move for the different heights for the vertical curbs. The lock collar 66 can be adjusted and tightened at the height level wanted to tack. The idler wheel 62 is the same style used in the Model MP300 and MP400, which is a clothes dryer drum roller. This will finish the u-bolt idler wheel assembly FIGS. 5 and 6, specifically designed for this model VC500.

ASSEMBLY OF FINGER HOOK ROD

The ⅜"×28" smooth finger hook rod 28 is bent one hundred eighty (180) degrees to form the hook, measuring from top of curve to bottom of hook rod 28 twenty-five and one-half inches (25½") long. The hook rod 28 is then debarred at the bottom. From the bottom of the hook rod 28 measuring up approximately sixteen and three-quarters inches (16¾") a ⅜" flat washer 34 is welded to the hook rod 28 approximately two inches (2") below where the 7⁄16" square nut 44 will be placed. The ⅜" washer 34 welded to hook rod 28 will be the stop, so hook rod 28 won't pull out of the cylinder 30/40. The ⅜" nut welded to 7⁄16" square nut 44 is slipped onto the top of the hook rod 28 thru the 7⁄16" square nut 44 which will be inside at the top of cylinder 30/40. Aligned that the hook rod 28 will go thru the hole in the 7⁄16" square nut 48 at the bottom of cylinder 30/40. The purpose of the 7⁄16" square nuts 44 and 48 will be for the hook rod 28 guides. The hook rod 28 will center align directly above the deflector 52 and fit in the hole G in cylinder cap 32/42. The hook rod 28 is adaptable to a right or left handed person.

Then the ⅜"×2" bolt 46 is inserted thru back of the shovel handle 20 hole A. The two ⅜" flat washers 34 are placed on the bolt 46 before the bolt 46 goes thru hole E in cylinder 30/40 to the ⅜" nut that is welded to 7⁄16" square nut 44 in cylinder 30/40, then screwed and tightened on the ⅜" nut 44.

KICK STAND & CYLINDER INSTALLATION

In FIG. 2 you will see a pull apart sketch on the TACK-IT EZ Model MP300. In FIG. 4 a pull apart sketch for the Model MP400. In FIG. 6 a pull apart sketch for the Model VC500. All of the models involved will take the same kick stand 24 and cylinder 30/40 installation procedure. A specially designed kick stand is fastened to underneath rolled edges of shovel head 22.

Cylinder 30/40 connects to shovel head 22 hole A, and shovel handle 20 hole B, with the two holes B to F and A to E aligning. The cylinder 30/40 is first installed at the bottom hole F with the 7⁄16" square nut welded to ⅜"×2" all thread bolt 48 that was inserted thru the cylinder 30, with the 7⁄16" square nut on the inside of cylinder 30/40. A ⅜" nut 50 will screw on at the open threaded end of the ⅜"×2" bolt 48 against the outside of the cylinder 30. This is the first of three ⅜" nuts 50, then the second of three ⅜" nuts 50, on bolt 48 making this a spacer, which is between the front side of shovel head 22 and cylinder 30/40. After inserting thru shovel head 22 the final ⅜" nut 50 is screwed on and tightened to set flush to the back side of the shovel head 22. This completes the installment of the bottom of cylinder 30/40 to shovel head 22.

A ⅜"×2" threaded bolt 46 is placed thru the hole A at back side of shovel handle 20, next two ⅜" flat washers 34 are placed on the bolt 46, before the ⅜"×2" bolt 46 is extended thru the hole E into the cylinder 30/40. This will screw to the open end of the ⅜" welded nut on the 7⁄16" square nut 44 that is on the hook rod.

INTERIOR DETAIL OF CYLINDER

FIGS. 2, 4 and 6, are showing the cylinder tube 30/40 with the two cut away sections on each drawing. Showing the hook rod 28 going thru the cylinder 30/40 and both of the square nuts, 44 down thru to the other square nut 48 to the bottom hole G. At the upper hole E on cylinder 30/40 you can see the two ⅜" washers 34, between shovel handle 20 and cylinder 30/40. At the bottom hole F you can see the three ⅜" nuts 50. One ⅜" nut 50 right behind cylinder 30/40, another right in front of the shovel head 22 and the last nut 50 behind the shovel head 22. You can also see the ⅜" washer 34 welded to the hook rod 28. This is described in previous paragraphs. This is used on all of the TACK-IT EZ applicator tools regardless of cylinder size, cylinder cap size or model design.

The FIGS. 1 thru 6, the cylinder 30/40, which can be either size cylinder. With the bottom 7⁄16" square nut welded to the ⅜"×2" bolt 48 in the cylinder 30/40, and displaying the same bolt 48 laying on the side of cylinder 30/40, with ⅜" nuts 50. Displayed are the tops of cylinder 30/40 bolts, ⅜" nut welded to 7/16" square nut 44, with the ⅜"×2" bolt 46 and ⅜" washer 34.

FINGER HOOK ROD IN CYLINDER

On the finger hook rod 28 a ⅜" flat washer 34 was welded to the hook rod 28 approximately two inches (2") below where the 7⁄16" square nut 44 will be placed on the inside of the cylinder 30/40 top hole E. In both of the 7⁄16" square nuts on items 44 and 48 these will be the guide holes for the hook rod 28. The hook rod 28 will be inserted thru and aligned with the hole G in bottom of cylinder cap 32/42. Using fingers, pull the hook rod 28 up or down in cylinder 30/40 for the opening and closure of the cylinder cap 32/42 hole G for the solution to be dispensed as needed.

DEFLECTOR IDLER WHEEL-Model MP300 & MP400

The ½"×6" threaded rod 54 is bent at an angle of approximately seventy (70) degrees, with three and one-half inches (3½") on one end of bend and two and one-half inches (2½") on the other end. Two ½" nuts 58 are threaded onto the rod 54 at the longer end three and one-half inches end (3½") halfway, the idler wheel 62 is put on, then the ½" self locking nut 56 at the end. A nut 58 is threaded on the rod 54 at the two and one-half inch (2½") shorter end. The deflector 52 with half inch (½") hole D is placed next to the nut 58 with small crimped end of deflector 52 at top flaring out on the shovel head 22. Another nut 58 is on back side of deflector 52 with a lock washer 60 next to front of shovel head 22. After lock washer 60 is put on the rod 54 it is put on the shovel head 22, the front angled down with the lock nut 56 to be put on the back of shovel head 22. All of the nuts 58 are tightened to secure the deflector 52 and idler wheel assembly 62. This unit should be pre-assembled and placed on shovel head 22 all except for the lock nut 56 to be put on rod which is extended thru shovel head 22. This is done only on the two models MP300 and MP400.

MODEL VC500

FIG. 5, is a sketch of the Model VC500, which does the vertical curb face. FIG. 6 is showing a pull apart sketch of Model VC500. Hole B on the shovel head 22, ⅜"×2" bolt welded to 7⁄16" square nut 48 will be inserted thru the hole F from the inside of the cylinder 30 aligning the 7⁄16" square nut 48 for the hook rod 28 to go in the cylinder 30 and thru 7⁄16" square nut that is welded to ⅜" threaded nut 48. The hook rod 28 will go to the bottom hole G and is used as a plug to close and open, to dispense solution when needed.

Inside the cylinder 30 upper hole E, on the ⅜"×2" bolt 46, the 7⁄16" square nut welded to ⅜" nut 44 will attach to the ⅜"×2" bolt 46. Hole A in shovel handle 20 and another hole B in the shovel head 22, to align with holes E and F on side top part and side bottom part of cylinder 30 and another hole G on the bottom of the cylinder cap 32 as the opening and closure hole G. The cylinder 30 is installed in the same way as Model MP300 and Model MP400. The ⅜"×2" threaded bolt 46 will be inserted thru the back side of shovel handle 20 of hole A, and upper side hole E in the cylinder 30 with two ⅜" washer 34 between the shovel handle 20 and the cylinder 30.

GENERAL DESCRIPTION

Figure 1:
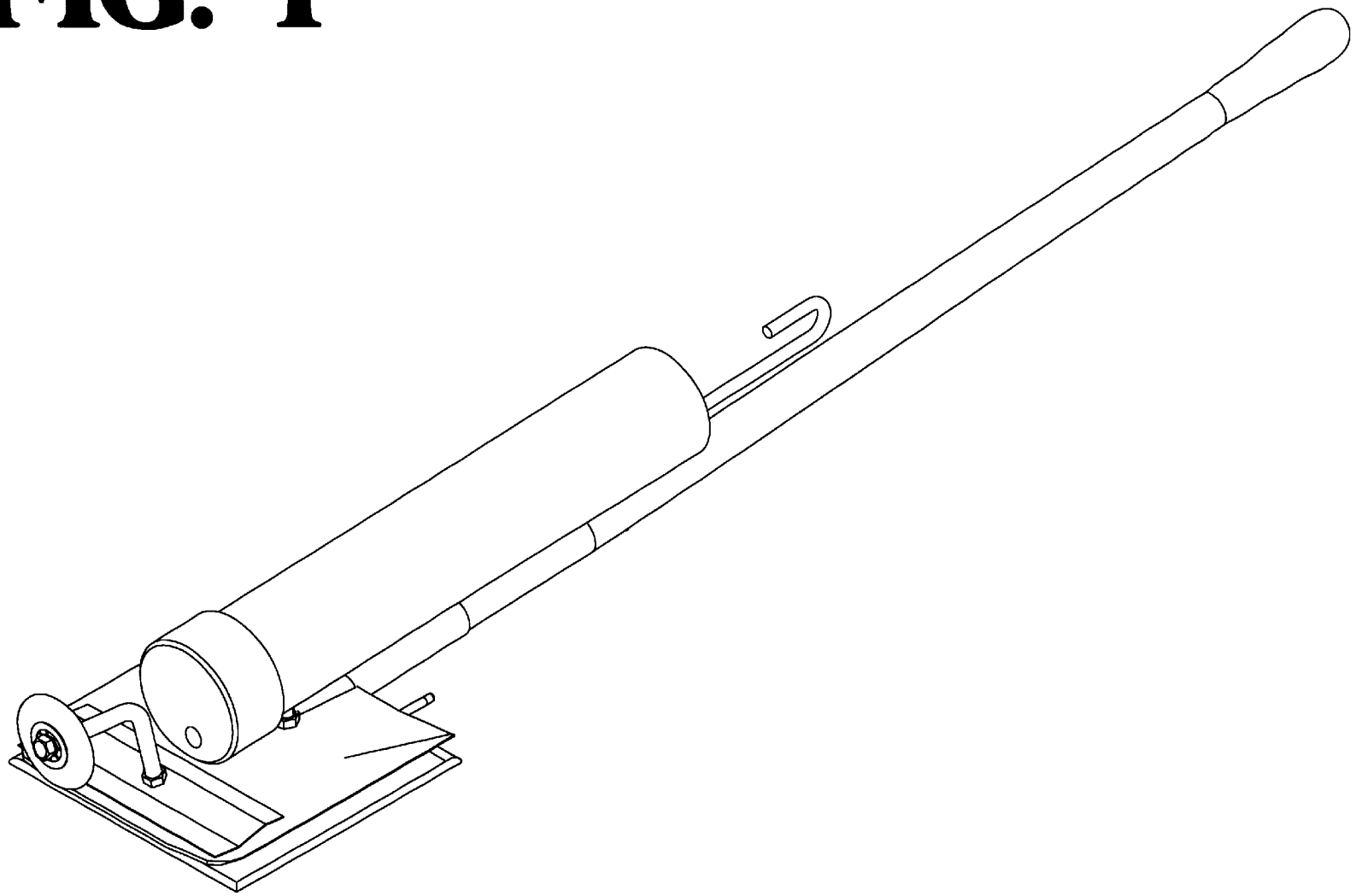
FIG. 1—Is a drawing of the asphalt tack tool known as TACK-IT EZ, showing the assembled side view of Model MP300, with a 3" cylinder and 3" cylinder cap and deflector shield with idler wheel on bottom of shovel head.
Figure 2:
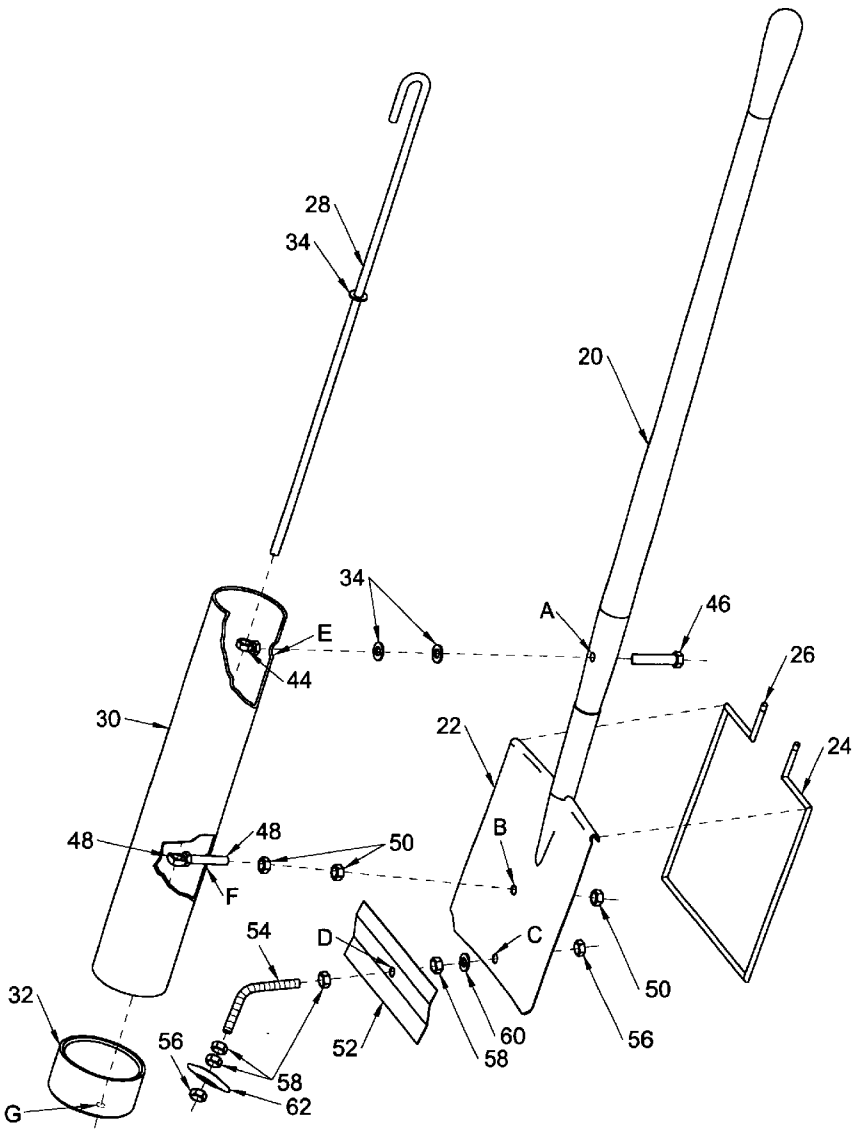
FIG. 2—Is a drawing of the asphalt tack tool, known as TACK-IT EZ, showing the pull apart view of the Model MP300.
Figure 3:
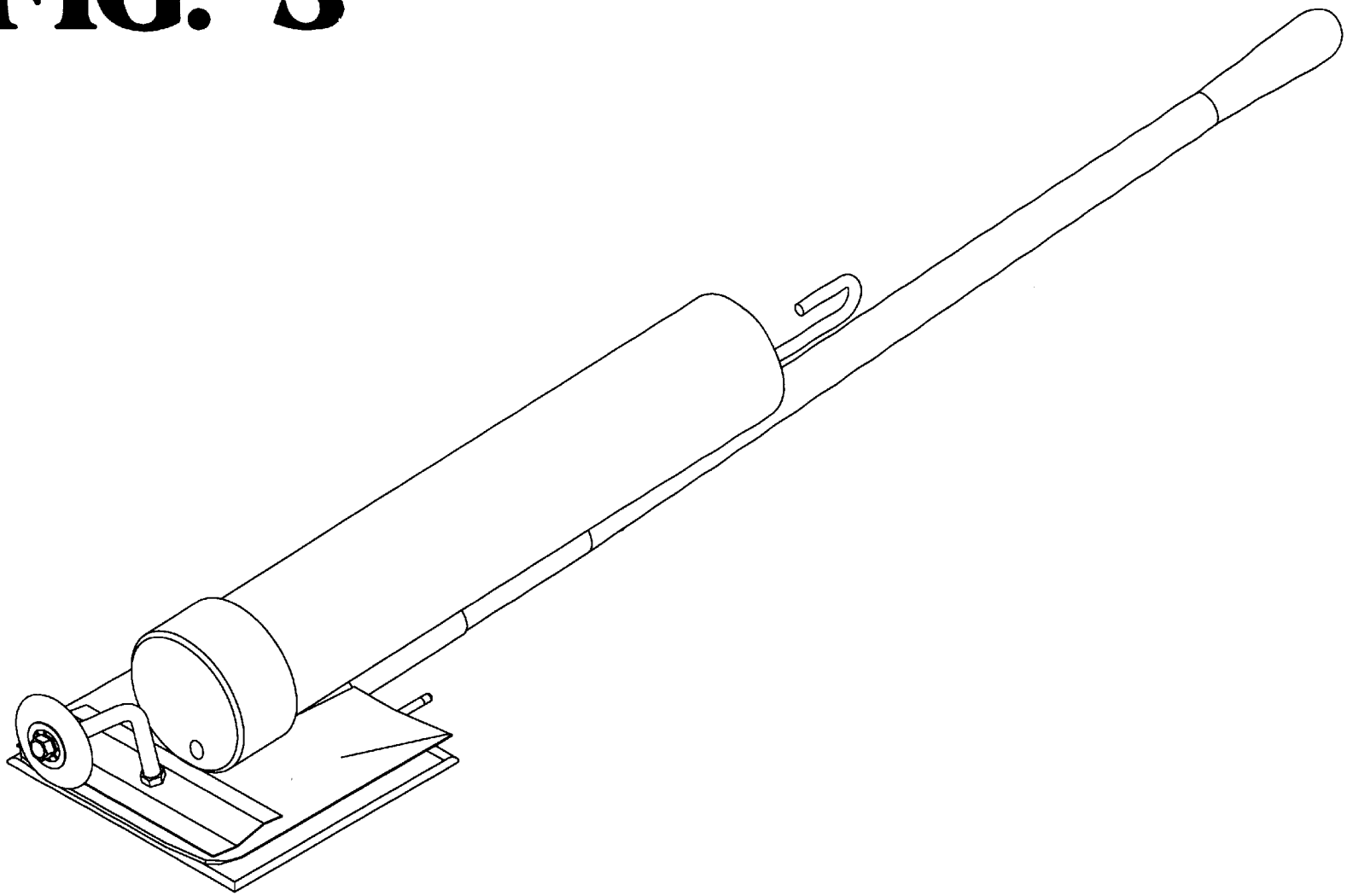
FIG. 3—Is a drawing of the asphalt tack tool, known as TACK-IT EZ, showing the assembled side view of Model MP400. The cylinder size and cylinder cap size are the differences between the Model MP300 and Model MP400. The Model MP400 has a 4" cylinder and 4" cylinder cap, also with the same deflector shield with idler wheel on the bottom of shovel head.
Figure 4:
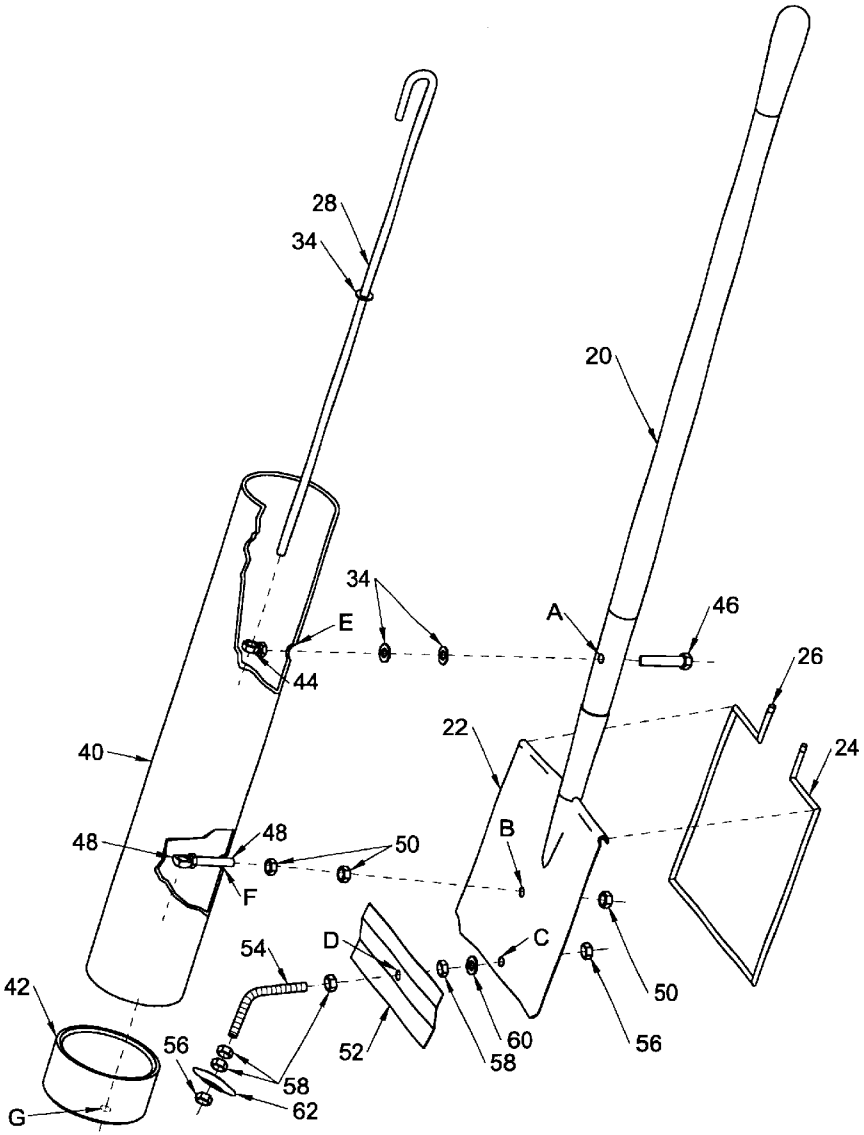
FIG. 4—Is a drawing of the asphalt tack tool, known as TACK-IT EZ, showing the pull apart view of the Model MP400. Everything used is the same as the Model MP300, except the Model MP400, has a 4" cylinder and 4" cylinder cap.
Figure 5:
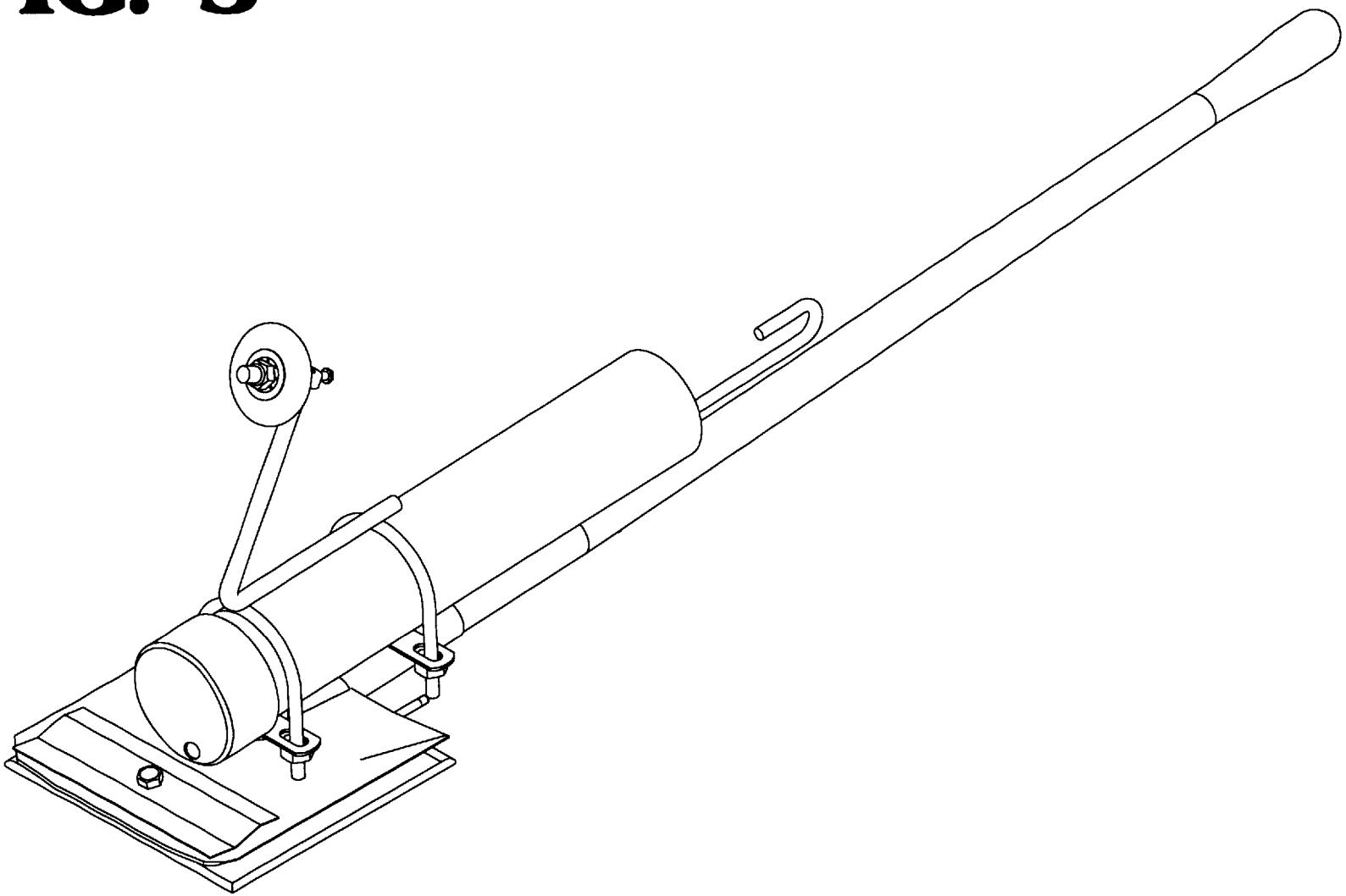
FIG. 5—Is a drawing of the asphalt tack tool, known as TACK-IT EZ, showing the side view of the assembled Model VC500. The difference between this model and the other two models is the idler wheel position, and that the idler wheel is adjustable to different heights. The idler wheel is positioned on the front of the u-bolt assembly, which is wrapped around in front of the 3" cylinder. This model is installed with the 3" cylinder and 3" cylinder cap.
Figure 6:
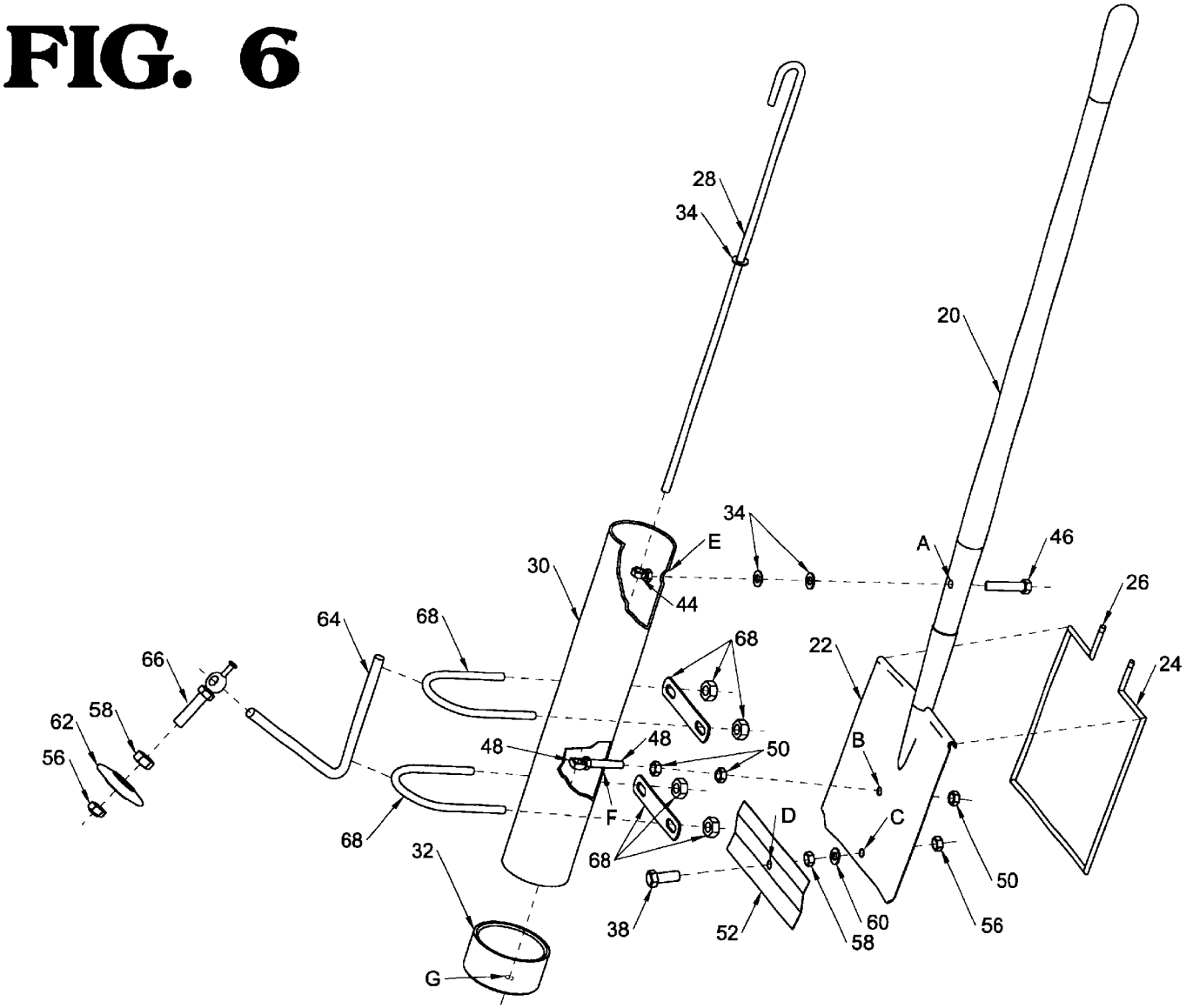
FIG. 6—Is a drawing of the asphalt tack tool, known as TACK-IT EZ, showing the pull apart view of the model VC500. Note the difference in the idler wheel assembly versus other models.

Simple Assembly Steps Step 1—To assemble the TACK-IT EZ, the first steps that are involved are to drill the holes B and C in the shovel head 22. A three-eighth inch (⅜") for hole B and one-half inch (½") hole for C.

Step 2—The kick stand 24 is attached under the rolled edges of the shovel head 22, the thread protectors 26 are put on the kick stand.

Step 3—The idler wheel 62 and deflector shield 52 will be assembled before attaching to the shovel head 22. The bottom of deflector shield 52 goes in toward shovel head 22 when installed, with the idler wheel 62 on front side which is angled down.

This step is also done for the vertical curb Model VC500, except the deflector shield 52 has very little assembly compared to the other Models MP300 and MP400.

With the Model VC500 the deflector 52 doesn't have the idler wheel 62 attached to this part.

On the Model VC500, the idler wheel 62 assembly is installed after cylinder 30 is attached with the u-bolt assembly 68.

Step 4—The cylinder 30/40 will be the next to assemble. This assembly has different steps that have to be followed in order, it is very important to follow the steps. Hole F is drilled first in cylinder 30/40 inserting the proper bolt and square nut 48. Important: Insert bolt first before gluing cylinder cap 32/42 to bottom of cylinder 30/40, if cap is glued first there is no way you can get bolt in cylinder 30/40. After bolt 48 is fastened to cylinder 30140, this is the stage that you can glue the cylinder cap 32/42 onto the bottom of the cylinder 30/40. Before the ⅜"×28" smooth hook rod 28 is inserted thru cylinder 30/40, a long narrow drill is put thru the guide hole, on the 7/16" square nut welded to ⅜"×2" all thread bolt 48 which will determine where ⅜" hole G is located on the bottom of cylinder cap 32/42. Important: that the ⅜" hole G lines up with hook rod 28. The ⅜" flat washer 34 is spot welded on the hook rod 28 then inserted inside the cylinder 30/40 to align with the square nut 48 guide hole and will fit into ⅜" hole G in bottom of cylinder cap.

The ⅜" hole B in shovel handle 20 is drilled with the cylinder 30/40 aligned for the ⅜" hole E at the same time for perfect alignment. The bolt 46 is inserted from the back of the shovel handle 20 and to the inside of cylinder 30/40. The ⅜" coarse thread hex nut welded to 7/16" square nut 44 is slipped over the hook part of the finger rod 28 and fastened to the threaded bolt 46 on the inside of cylinder 30/40. The cylinder 30/40, cylinder cap 32/42, hook rod 28 with the holes E, F with the nuts and bolts is the procedure that is done for all the models involved.

Step 5—Preparing the u-bolt assembly 68 to attach and wrap around the cylinder 30 with the idler wheel 62 slipped over the rod 64. The idler wheel 62 is welded to the u-bolt assembly 68. This step is only done on the Model VC500.

OPERATION OF INVENTION

The TACK-IT EZ is used to apply tack coat which is a light application of diluted asphalt emulsion. It is used to ensure a bond between a surface being paved and the new asphalt, in this case for the curb face or edges. The more common emulsion types for tack coats are diluted, the tack coat is a black liquid solution. With the TACK-IT EZ and kick stand 24 holding the TACK-IT EZ to stand by itself, the tack is poured into the cylinder tube 30/40 after tack is diluted. The kick stand 24 is pushed with foot to shovel head 22 and with the TACK-IT EZ in hand the idler wheel 62 is put on the curb or edge. The hook rod 28 is lifted up to engage, allowing the tack solution to flow out the bottom hole G, tack enters between the shovel head 22 and the deflector 52. The operator is moving the TACK-IT EZ along the curb or edge, allowing the tack coat to be evenly applied and dispensed on the curb face or road edge.

This is a messy job and can be a back breaking one. The TACK-IT EZ eliminates some of the mess. With the TACK-IT EZ in hand most of the bending and back breaking parts of the job are eliminated because of the TACK-IT EZ's unique design. The TACK-IT EZ has different features that are a benefit. For instance with the kick stand 24 the sole operator has the advantage of having both hands free to refill the cylinder. Also another feature is the advantage of the ability of the 3" cylinder 30 holding approximately one-half gallon of diluted tack, increasing to a 4" cylinder 40 holding approximately one gallon of diluted tack. Distribution of tack solution depends on many factors, for instance: the curbs or edges on the job, the cylinder size and the individual operator's disbursement technique.

Conclusion, Ramifications, and Scope of Invention

There have been variable changes from the original device used in the beginning. From the squared point shovel was added a cylinder or container designed out of available products, to hold the solution in variable measurements. The cylinder, pipe, container depends on the capacity required for job specifications.

The TACK-IT EZ flexibility is engineered into being customized for construction and manufacturing of the job specifications and design products availability. TACK-IT EZ will also differ with the material used in the cylinder, and the shovel to be used can be adapted to availability and flexibility of shovel size and designs.

If the shovel is not the driver of choice the TACK-IT EZ tool is engineered to be adaptable to a variety of drivers as jobs require and to suit product availability. The deflector which can be made from a number of materials such as steel, metal, and plastic may vary and may increase or decrease depending upon shovel size availability.

The rod hand handle, lever, eye hook or finger loop to be used may vary depending on models made. It is flexible to turn left or right or which ever situation is called for. The length is variable also depending on cylinder being used. TACK-IT EZ will go in a circular motion as well as lift up and down to plug the hole that the asphalt emulsion is released from and dispensed between the deflector and the shovel head. Placement of the stop on the hook rod hand handle assembly depends on size of cylinder length.

The idler wheel may vary in diameter to be determined on the job specifications, as may the angle on the wheel to the shovel depending on the shovel blade, angle to curve 50 to 80 degrees on the shovel blade from the threaded rod which holds the driver wheel. The threaded rod is engineered to be adaptable to other extension devices as connecting hardware and other design applications require suitable adjustments.

When the vertical curbs are present the TACK-IT EZ will accommodate that situation also. With the Model VC500 an extension was devised for the vertical curb face. For the rolled curbs with the valley gutters, any other type of curbs, or saw cut edges for the patching, or for expanding asphalt width, the Model MP300 or MP400 can be used.

This has always been a slow tedious procedure with not too many people figuring ways to do this job better. Needless to say, it has always been messy, spilling tack all over the place and even on the sidewalk or concrete curb. Then you add the extra job of cleaning tack off the concrete. This job usually takes two people, one person dipping the cup in the liquid diluted tack and pouring the liquid on the shovel while the other person is walking along the side of curb, or just holding the cup along the side of curb while letting the liquid tack coat the curb or edge. For the bigger paving companies that have a tack trailer with a spray wand to spray the curb or edge, it still can be a handicap. One person spraying with another person pulling the tack trailer. For big or small companies there are numerous advantages to owning the TACK-IT EZ. A big advantage is that it allows one person to be the sole operator. Easy clean up to the TACK-IT EZ is a big plus. It doesn't take up another vehicle space like a tack trailer would. TACK-IT EZ is efficient for both big and small jobs. The expense of owning TACK-IT EZ is small in comparison to other equipment.

The operator now is one person where two were previously used to perform this messy and slow job. TACK-IT EZ provides the potential of eliminating one man therein allowing the other man to be available for another job on the paving crew.

Any parts for the TACK-IT EZ as listed in the specifications and drawings of details, can be substituted as product availability requires as long as the integrity of the TACK-IT EZ is maintained.

The above asphalt tack device is the achievement of many working years to develop the right design The asphalt tack device is truly a good idea and has been used with a paving company that we were associated with for the last six years. Different designs have been used but this design by far is the one that seems to have been the favorite of the paving crew. The on the job experience with the TACK-IT EZ has been a valuable asset for saving time and material.

We claim:

1. An asphalt tacking device for dispensing or applying emulsion solution on the side of concrete or asphalt curbs comprising:

(a) a shovel comprising a shovel handle and a square shovel head, said square shovel head having a top edge, said shovel having a front and back, (b) a rod kick stand having an outer perimeter replicating the shape of the square shovel head, the kick stand attached to the top edge of the shovel head, (c) a cylinder for holding said emulsion solution mounted on the front of the shovel handle and extending down in front of the shovel head, said cylinder having a cylinder cap with a bottom, said cylinder cap attached to the bottom of the cylinder, the cylinder cap including a hole at the bottom of the cylinder cap to release the emulsion solution, (d) a finger rod located within the cylinder, the cylinder including means to slidably attach the finger rod within the cylinder, wherein the finger rod is aligned with the hole in the bottom of the cylinder cap, and (e) a crimped deflector shield attached to the front of the shovel head for controlling even distribution of the emulsion solution, an idler wheel attached to the crimped deflector shield by an angled threaded rod.

2. An asphalt tacking device as defined in claim 1, wherein said shovel handle is a solid tubular shape.

3. An asphalt tacking device as defined in claim 1, wherein said means to slidably attach the finger rod within the cylinder includes guide devices inside said cylinder to guide and align said finger rod in and out the hole at the bottom of the cylinder cap, thereby opening and closing the hole and allowing solution to be dispensed as needed.

4. An asphalt tacking device for dispensing or applying emulsion solution on the side of concrete or asphalt curbs comprising:

(a) a shovel comprising a shovel handle and a square shovel head, said square shovel head having a top edge, said shovel having a front and back, (b) a rod kick stand having an outer perimeter replicating the shape of the square shovel head, the kick stand attached to the top edge of the shovel head, (c) a cylinder for holding said emulsion solution mounted on the front of the shovel handle and extending down in front of the shovel head, said cylinder having a cylinder cap with a bottom, said cylinder cap attached to the bottom of the cylinder, the cylinder cap including a hole at the bottom of the cylinder cap to release the emulsion solution, (d) a finger rod located within the cylinder, the cylinder including means to slidably attach the finger rod within the cylinder, wherein the finger rod is aligned with the hole in the bottom of the cylinder cap, and (e) a U-bolt assembly fixedly attached around the cylinder at a location between the shovel head and the back of the cylinder, a 60 degree angled rod attached to the U-bolt assembly, and an idler wheel slipped on an outward extension of the angled rod having a lock collar, (f) a crimped deflector shield attached to the front of the shovel head for controlling even distribution of the emulsion solution.

5. An asphalt tacking device as defined in claim 4, wherein said shovel handle is a solid tubular shape.

6. An asphalt tacking device as defined in claim 4, wherein said means to slidably attach the finger rod within the cylinder includes guide devices inside said cylinder to guide and align said finger rod in and out the hole at the bottom of the cylinder cap, thereby opening and closing the hole and allowing solution to be dispensed as needed.

* * * * *